US010550578B2

(12) United States Patent
O'Neal

(10) Patent No.: US 10,550,578 B2
(45) Date of Patent: Feb. 4, 2020

(54) SIDING ATTACHMENT SYSTEM

(71) Applicant: Jerry D. O'Neal, Independence, MO (US)

(72) Inventor: Jerry D. O'Neal, Independence, MO (US)

( * ) Notice: Subject to any disclaimer, the term of this patent is extended or adjusted under 35 U.S.C. 154(b) by 0 days.

(21) Appl. No.: 16/013,498

(22) Filed: Jun. 20, 2018

(65) Prior Publication Data

US 2019/0390462 A1 Dec. 26, 2019

(51) Int. Cl.
*E04F 13/08* (2006.01)

(52) U.S. Cl.
CPC ..... *E04F 13/0803* (2013.01); *E04F 13/0864* (2013.01); *E04F 13/0876* (2013.01); *E04F 13/0878* (2013.01)

(58) Field of Classification Search
CPC ..... E04F 13/0803; E04F 13/0864; E04F 13/0876; E04F 13/0878; E04F 13/076; E04F 13/08; E04F 13/0801; E04F 13/0832; E04F 13/0857; E04F 13/0875; E04F 13/21; E04F 13/22; E04F 13/23; E04F 13/24; E04F 13/25; E04F 13/26; E04F 13/28
USPC ..... 52/518, 519, 520, 543, 545, 546, 547, 52/549, 551
See application file for complete search history.

(56) References Cited

U.S. PATENT DOCUMENTS

| | | | |
|---|---|---|---|
| 1,321,958 | A | 11/1919 | Wardell |
| 1,357,265 | A | 11/1920 | Woerheide |
| 2,126,676 | A | 8/1938 | Thomas |
| 2,128,495 | A | 8/1938 | Murphy |
| 2,293,744 | A | 8/1942 | Miles et al. |
| 2,325,124 | A | 7/1943 | Gardner |
| 2,535,620 | A | 12/1950 | Alvarez, Jr. |
| 2,632,538 | A | 3/1953 | Schmidt, Jr. |
| 2,648,104 | A | 8/1953 | Scott et al. |
| RE24,675 | E | 7/1959 | Zarnowski |
| 3,110,130 | A | 11/1963 | Trachtenberg |
| 3,173,229 | A | 3/1965 | Weber |
| 3,233,382 | A | 2/1966 | Graveley, Jr. |
| 3,258,887 | A | 7/1966 | Mostoller |
| 3,504,467 | A | 4/1970 | Hatch et al. |
| 3,520,099 | A | 7/1970 | Mattes |
| 3,552,078 | A | 1/1971 | Mattes |
| 3,703,062 | A | 11/1972 | McKinney |

(Continued)

*Primary Examiner* — Ryan D Kwiecinski
*Assistant Examiner* — Matthew J Gitlin
(74) *Attorney, Agent, or Firm* — Erickson Kernell IP, LLC; Kent R. Erickson

(57) ABSTRACT

A siding assembly includes a siding panel and an insulating panel securable to a wall using a siding attachment member. The siding attachment member includes openings extending therethrough in equally spaced relationship that align with slots formed in the foam panel. The spacing between centers of the foam panel slots corresponds to the spacing between centers of the openings in the attachment member. The slots in the foam panels are sufficiently wide to allow the foam panel to slide relative to the fasteners securing the foam panel to a wall. The siding attachment member may comprise a bracket with legs projecting rearward from a web and a siding support shoulder formed at a lower end of the web. Lines of weakness in the web and aligned notches in the shoulder facilitate cutting the bracket to a desired length. Reinforcement ribs are formed in the bracket web.

17 Claims, 5 Drawing Sheets

(56) References Cited

U.S. PATENT DOCUMENTS 3,738,076 A 6/1973 Kessler
3,757,483 A 9/1973 Tobett
3,824,756 A 7/1974 Kessler
3,828,510 A 8/1974 Bettoli
3,999,348 A 12/1976 Hicks
4,015,391 A 4/1977 Epstein et al.
4,047,349 A 9/1977 Aguilar, Jr.
4,063,395 A 12/1977 Stewart et al.
4,102,106 A * 7/1978 Golder ..... E04F 13/0864 52/533
4,104,841 A * 8/1978 Naz ..... E04F 13/0864 52/519
4,122,643 A 10/1978 Hafner
4,186,538 A 2/1980 Marcum, Jr.
4,292,781 A 10/1981 Chalmers et al.
4,327,528 A 5/1982 Fritz
4,348,849 A 9/1982 Wollam et al.
4,424,655 A 1/1984 Trostle
4,435,933 A 3/1984 Krowl
4,435,938 A 3/1984 Rutkowski et al.
4,506,486 A * 3/1985 Culpepper, Jr. ..... E04D 1/28 52/529
4,577,442 A 3/1986 Callaway
4,646,501 A 3/1987 Champagne et al.
4,686,803 A * 8/1987 Couderc ..... B29C 35/16 52/97
4,712,351 A * 12/1987 Kasprzak ..... E04F 13/0864 52/547
4,782,638 A 11/1988 Hovind
5,016,415 A 5/1991 Kellis
5,150,555 A 9/1992 Wood
5,339,608 A 8/1994 Hollis et al.
5,363,623 A 11/1994 King
5,392,579 A 2/1995 Champagne
5,443,878 A * 8/1995 Treloar ..... E04D 3/35 428/100
5,490,359 A 2/1996 Hepler
5,575,127 A 11/1996 O'Neal
5,581,968 A * 12/1996 Laurie ..... E04F 13/18 52/536
5,617,690 A 4/1997 Gibbs
5,622,020 A 4/1997 Wood
5,634,314 A * 6/1997 Champagne ..... F16B 2/245 52/520
5,651,227 A * 7/1997 Anderson ..... E04F 13/0864 52/519
5,675,955 A * 10/1997 Champagne ..... E04F 13/0864 52/519
5,685,117 A * 11/1997 Nicholson ..... E04D 1/18 52/520
5,694,728 A 12/1997 Heath, Jr. et al.
5,878,543 A 3/1999 Mowery
6,000,185 A 12/1999 Beck et al.
6,029,415 A 2/2000 Culpepper et al.
6,134,855 A 10/2000 Beck
6,195,952 B1 3/2001 Culpepper et al.
6,263,574 B1 * 7/2001 Lubker, II ..... B29C 47/0019 29/419.1
6,295,777 B1 10/2001 Hunter et al.
6,321,500 B1 * 11/2001 Manning ..... E04F 13/0864 52/309.8
6,351,921 B1 * 3/2002 Roberson ..... E04F 13/0864 52/506.1
6,363,676 B1 * 4/2002 Martion, III ..... E04F 13/0864 52/519
6,367,220 B1 4/2002 Krause et al.
6,393,792 B1 5/2002 Mowery et al.
6,421,964 B1 7/2002 Schiedegger
6,505,451 B1 1/2003 Ksajikian
6,526,718 B2 3/2003 Manning et al.
6,560,945 B1 5/2003 Carpenter
6,718,719 B1 4/2004 Hagerty
6,971,211 B1 * 12/2005 Zehner ..... E04F 13/0864 428/516
6,988,345 B1 1/2006 Pelfrey et al.
D530,833 S * 10/2006 Robertson ..... D25/121
7,124,548 B2 10/2006 Pressutti
7,186,457 B1 * 3/2007 Zehner ..... C08L 27/06 428/326
7,225,592 B2 6/2007 Davis
7,383,669 B2 6/2008 Morse
7,441,383 B2 10/2008 O'Neal
7,658,051 B2 2/2010 Benes
7,712,276 B2 5/2010 Gilbert et al.
7,762,040 B2 * 7/2010 Wilson ..... E04F 13/0864 52/518
7,779,594 B2 8/2010 Mowery et al.
7,980,038 B2 7/2011 O'Neal
8,381,472 B1 2/2013 Fleenor
8,629,203 B2 * 1/2014 Hawrylko ..... C08J 5/045 524/13
9,073,295 B2 * 7/2015 Przybylinski ..... B32B 27/04
9,138,945 B2 * 9/2015 Rimmer ..... B29C 41/003
9,290,943 B2 3/2016 Grubka
D818,151 S * 5/2018 Sexton ..... D25/139
2001/0013211 A1 * 8/2001 Rudden ..... E04C 2/296 52/539
2002/0029537 A1 3/2002 Manning et al.
2002/0043037 A1 4/2002 Dorsey et al.
2004/0003566 A1 1/2004 Sicuranza
2005/0072093 A1 4/2005 King
2005/0081468 A1 * 4/2005 Wilson ..... E04F 13/007 52/528
2006/0053734 A1 3/2006 Anderson
2006/0075712 A1 * 4/2006 Gilbert ..... B32B 5/18 52/520
2007/0175154 A1 * 8/2007 Wilson ..... E04F 13/007 52/521
2007/0193177 A1 * 8/2007 Wilson ..... E04F 13/0864 52/518
2007/0212970 A1 * 9/2007 Rockwell ..... D04H 1/48 442/394
2009/0000244 A1 * 1/2009 O'Neal ..... E04F 13/0864 52/763
2009/0038252 A1 * 2/2009 King ..... E04F 13/0876 52/506.05
2010/0242398 A1 * 9/2010 Cullen ..... B32B 3/06 52/588.1
2010/0281801 A1 * 11/2010 Shaw ..... B32B 5/18 52/302.1
2015/0059272 A1 * 3/2015 Husler ..... E04B 2/56 52/302.3
2017/0234019 A1 * 8/2017 Culpepper ..... B32B 27/34 52/539

* cited by examiner

Fig.1.
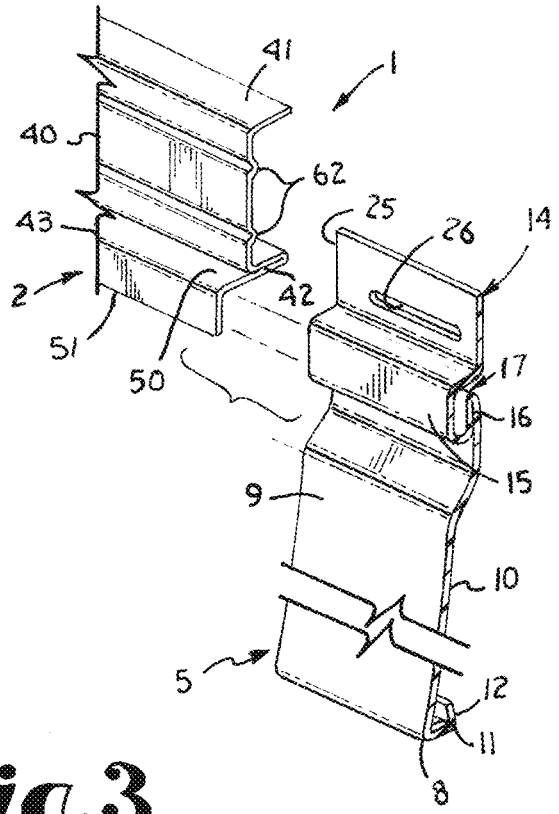
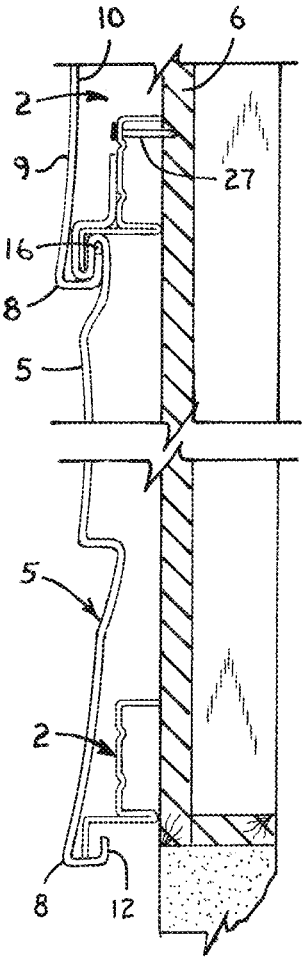
Fig.3.
Fig.2.
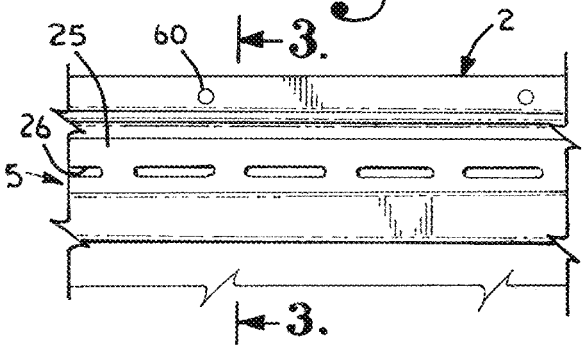

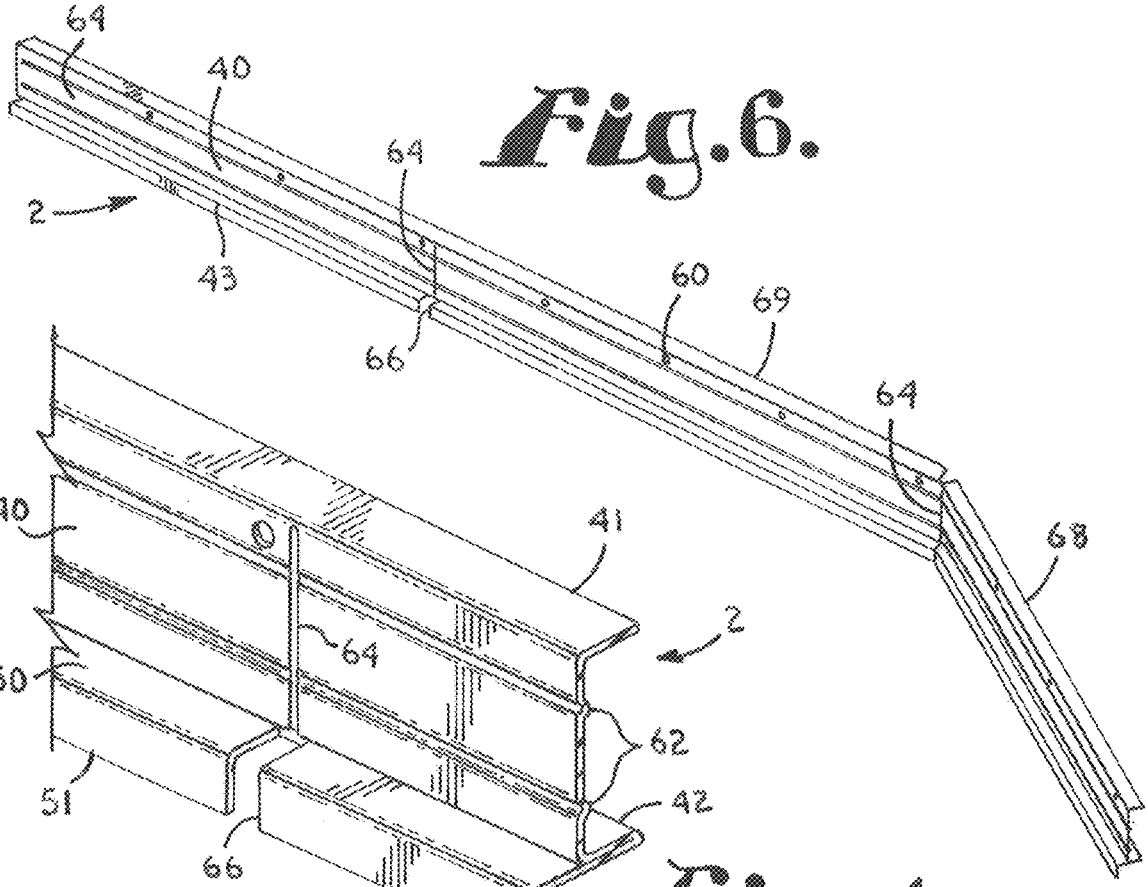
Fig.6.
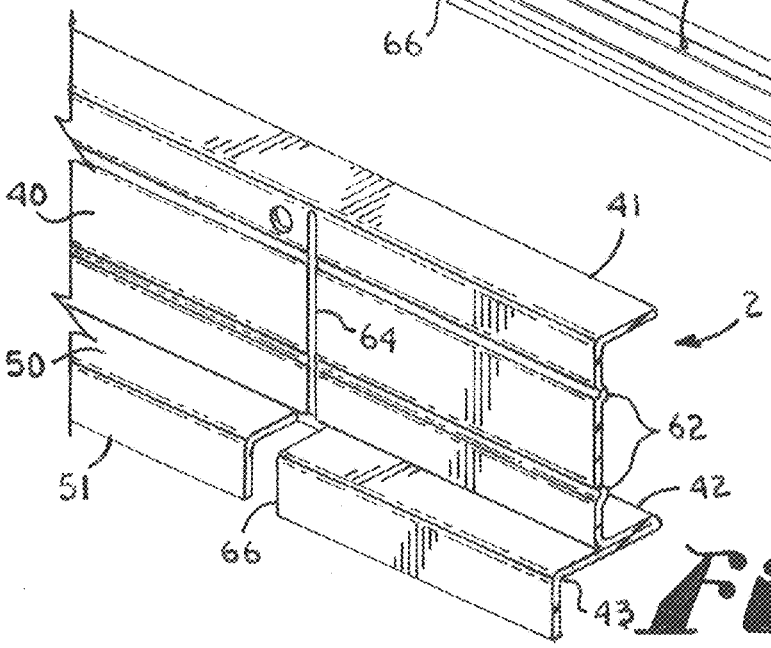
Fig.4.
Fig.5.
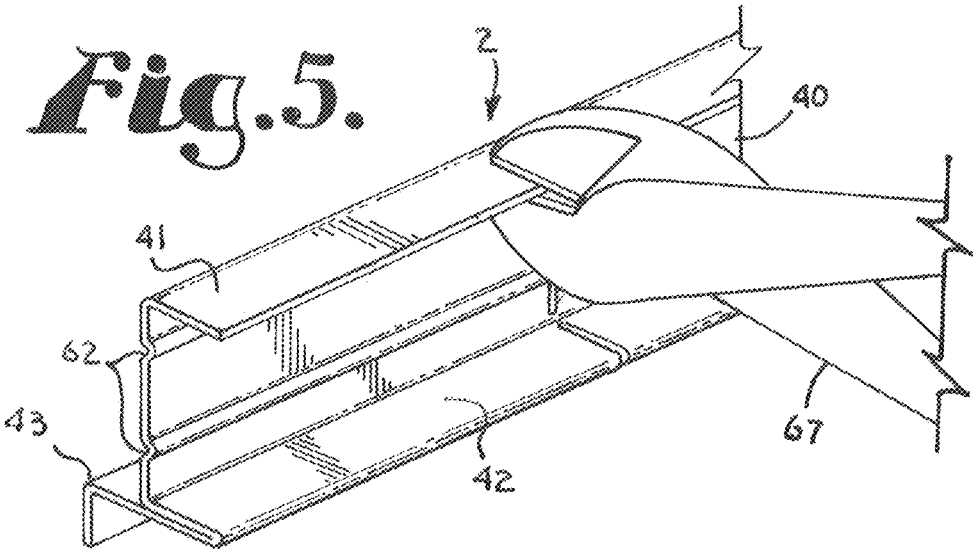

99
95
60
95
77
2
88
86
89
93
84
25
78
5
75
82
81
25
88
91
5
75

41
88
2
27
25
93
42
5
6
75
91
8
2
27

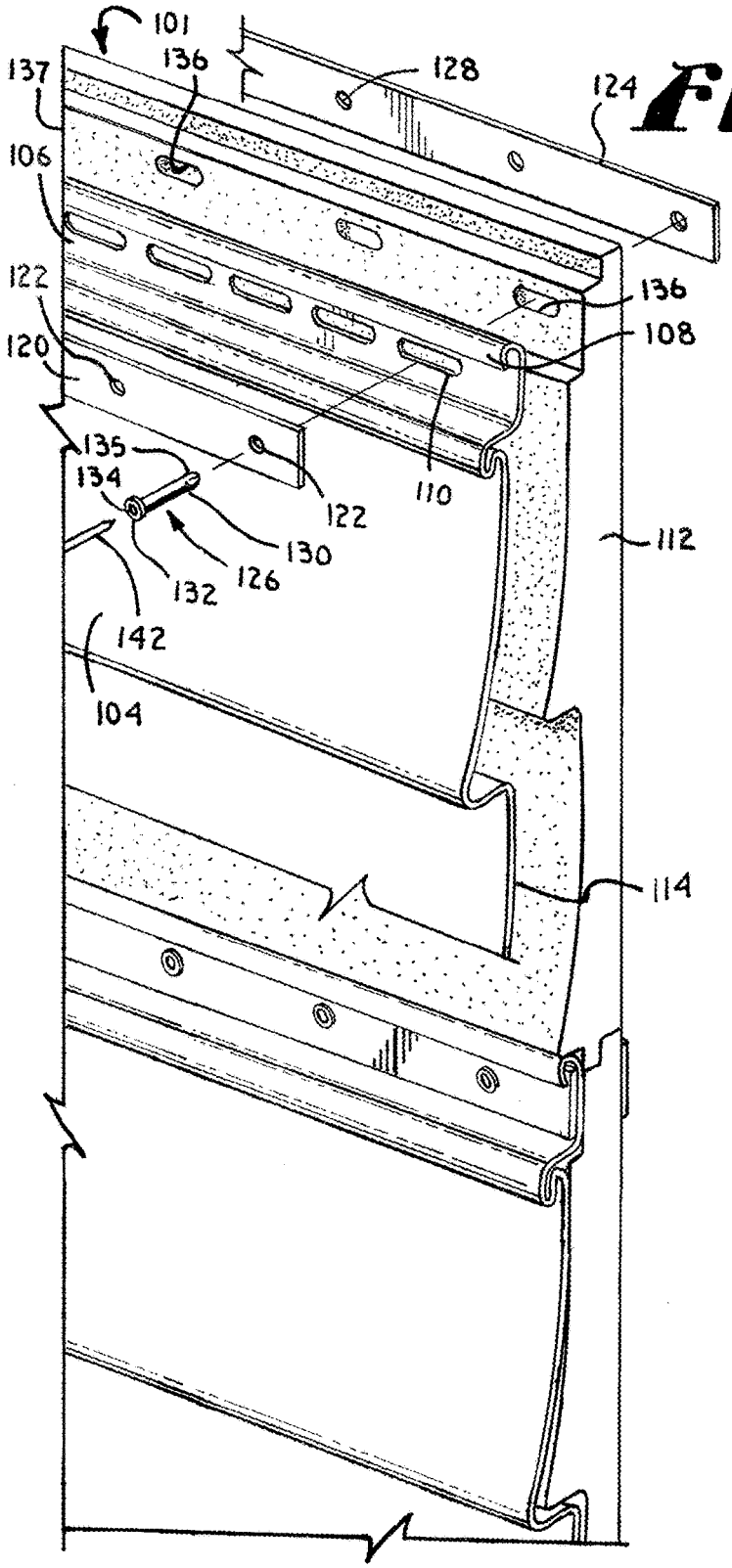
Fig. 9.
Fig. 10.
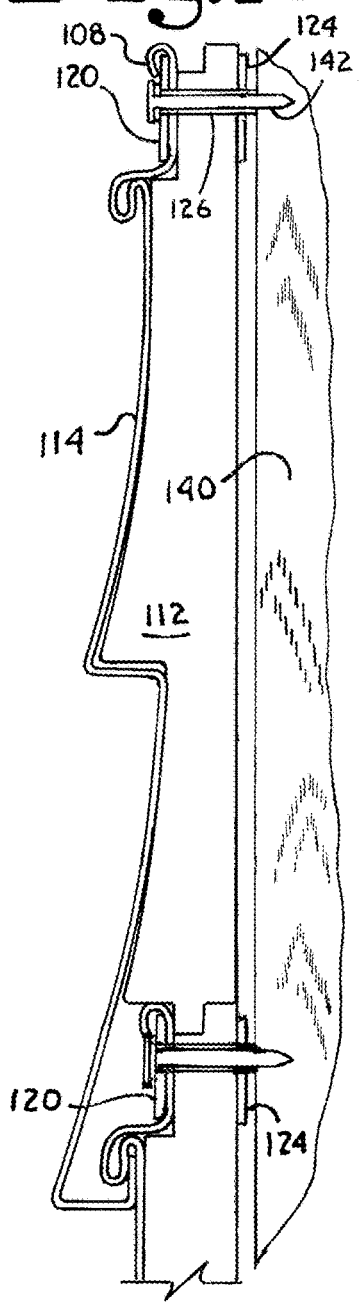

SIDING ATTACHMENT SYSTEM

BACKGROUND OF THE INVENTION

Field of the Invention

The present invention relates to the attachment of vinyl or metal siding to a building.

Description of the Related Art

Metal and plastic siding are commonly used as an imitation and substitute for wooden lap siding. The metal and plastic siding provide the appearance of wood siding while generally having a longer life span and require less maintenance. Metal siding is typically formed of aluminum or steel while plastic siding is conventionally formed of extruded sections of thermoplastic polyvinyl chloride which is commonly referred to as vinyl siding. In both types of siding, the bottom margin of each panel is typically bent inwardly and then upwardly to form a longitudinal channel with an upstanding inner leg. The top portion of each panel is formed to provide an outwardly and downwardly projecting longitudinal lip corresponding to the channel running along the bottom of the panel positioned thereabove. A securement flange extends above the longitudinal lip of each panel. The panels are typically secured to a wall along their top portions utilizing fasteners driven through the securement flange extending along the top of each panel.

One problem common to both metal and vinyl siding is its tendency to expand and contract with changes in temperature. Because of this problem, it has been a practice to incorporate longitudinally extending nail slots along the securement flange through which nails may be driven. It is intended that the nails be driven into the slots a distance sufficient to support the siding but not far enough that the head of the nail would engage the siding pressing it against the side of the building and preventing slidable movement of the siding along the nail through expansion and contraction of the siding. The primary problem with such nail slots is the difficulty in driving a nail or other fastener through the nail slots without fastening the nail too tight thereby preventing slidable movement. This is particularly true when the fasteners are applied utilizing power tools.

Siding clips as shown in U.S. Pat. Nos. 4,435,933 and 5,150,555 have been developed to overcome the problem of nailing siding too tightly to the wall to which it is secured. Each of the clips generally includes an upper hanger portion which may be nailed to the wall to which the siding is to be secured and a lower portion shaped to receive the upper portion of the siding in a channel or slot while allowing the siding to freely slide laterally through expansion and contraction. One drawback to such clips is that in use it is generally time consuming to slide a large number of clips onto long sections of siding from the ends to provide the appropriate number of clips for supporting the siding. Further, it is then difficult to maneuver the siding with the clips secured thereto prior to securement to the building without having the clips slide off the end of the siding.

An additional problem associated with conventional methods for hanging siding which is not corrected through use of siding clips is the tendency of vinyl siding to conform to irregularities or bows of a wall. Because vinyl siding is extremely flexible, the siding will conform to the shape of the wall to which it is attached when it is secured thereto by nailing or through the use of the clips noted above. As a building settles and ages, movement of the foundation and warping, racking or twisting of wood framing members through weathering and natural drying processes results in irregularities and distortions of the wall surface of the building. The materials of construction of a wall to which siding is to be attached may present inherently irregular surfaces such as stucco walls, stone walls or other types of siding. In addition, other factors, such as sloppy construction may cause distortion of the wall surface of a building such that the surface is not flat and is wavy or undulates. Current fastening systems for siding are inadequate to prevent the siding from conforming to such irregularities in the shape of building walls.

Although metal siding tends to be more rigid than vinyl siding, sections of metal siding spanning inward bows on a wall on which it is hung are insufficiently rigid to prevent indentation and permanent deformation of the siding when pressure is exerted against the section of siding spanning such an inward bow. Existing siding attachment systems do not provide sufficient additional rigidity to prevent such permanent deformation.

Another drawback of existing siding attachment systems including nailing and the use of clips is uneven sagging. Over time the siding tends to sag. When nails or clips are use to support siding the nails or clips are generally driven into or secured to the framing studs spaced sixteen inches apart such that the siding panels are supported every sixteen inches but not therebetween. Over time the unsupported sections of the siding panel will droop or sag further than the supported sections resulting in an uneven, wavy appearance.

In U.S. Pat. No. 5,575,127, I disclosed an elongate bracket for securing and supporting a siding panel relative to a wall formed from a plurality of uniformly spaced studs. The bracket included a vertically extending web and a pair of legs projecting rearward from upper and lower edges of the web and an L-shaped siding support shoulder formed adjacent to and extending forward and then downward from the lower edge of the web. The siding support bracket disclosed in U.S. Pat. No. 5,575,127 has been commercially successful. However, some siding installers have resisted using the bracket due to the added cost of materials and labor for installing the bracket before attachment of the siding to the bracket. The siding support bracket is also not adapted for use in installations in which foam insulating panels are to be installed behind the siding. There is a need for improvements to the siding support bracket which will reduce the cost to install and which can be used with siding panel assemblies including rigid foam insulating panels of the type shown in my prior U.S. Pat. No. 7,890,038. There is also a need for improvements to the rigid foam insulating panels to address issues with deformation and cracking of foam panels as walls to which they are attached settle.

SUMMARY OF THE INVENTION

One aspect of the present invention comprises an improvement to my siding support bracket disclosed in U.S. Pat. No. 5,575,127. The previously disclosed bracket comprises a generally vertically extending web having a plurality of holes formed in an upper portion of the web and extending across the web in linear alignment. The holes are sized to receive the shaft of a fastener therethrough but sized smaller than the head of the fastener. The bracket further includes at least one and preferably two support legs extending rearwardly from the web and a siding support shoulder including a horizontal leg and a vertical leg is formed on the bracket. The horizontal leg of the bracket is connected to the web at a first end and extends forwardly from the web and ends at a distal end and the vertical leg extends downwardly from the distal end of the horizontal leg. The improvement comprises forming a plurality of vertically extending score lines in the vertically extending web in equally spaced relationship and a plurality of notches in the vertical and horizontal legs of the siding support shoulder wherein each of the plurality of notches is axially aligned with a respective one of the plurality of vertically extending score lines formed in the vertically extending web. The notches and score lines facilitate cutting the bracket to a selected length of a standard increment but first cutting through the support legs with metal snips and then along the score line or by bending the bracket repeatedly along the score line.

At least one longitudinally extending stiffening rib may be formed in the vertically extending web to provide further rigidity to the bracket. In a preferred embodiment, two stiffening ribs are formed in the web of the bracket and extend in parallel spaced relation.

The prior bracket or improved bracket may be used in combination with a rigid foam insulating panel having a plurality of elongate slots formed in an upper section of the rigid foam insulating panel and extending in longitudinal alignment and equal spaced relationship thereacross. Centers of adjacent elongate slots in the rigid foam insulating panel are spaced apart a distance corresponding to a distance between centers of selected holes in the vertically extending web and the siding attachment bracket. A bracket is positionable against the rigid foam insulating panel such that selected holes in the vertically extending web of the bracket extend in overlapping alignment with the elongate slots formed in the rigid foam insulating panel. Each slot is substantially longer than the width of the fastener so that the foam panel can slide or translate laterally relative to fasteners driven through the fastener receiving holes in the bracket and the slots in the foam panel.

Each rigid foam insulating panels may also include a first overlapping feature formed on an upper end thereof and a second overlapping feature from on a lower end thereof. The second overlapping feature on a first rigid foam insulating panel extends in overlapping relationship with the first mating feature on a second rigid foam insulating panel positioned below and adjacent the first rigid foam insulating panel. The first overlapping feature may be an upstanding lip projecting upward from an upper end of each foam panel and the second overlapping feature may be a depending lip projecting downward from a lower end thereof. The upstanding lip on a first rigid foam insulating panel extends in vertical overlapping relationship with the depending lip on a second rigid foam insulating panel positioned above and adjacent the first rigid foam insulating panel during installation.

The rigid foam insulating panel may be used with siding attachment members or siding attachment means other than the siding support brackets. For example, the rigid foam insulating panels with elongate slots may also be used with elongate guide strips of the type shown in my prior U.S. Pat. No. 7,890,038. In either application, the siding attachment member includes a plurality of fastener receiving openings extending through the siding attachment member in equally spaced relationship, longitudinally thereacross. The siding attachment member is positionable in overlapping relationship with the rigid foam insulating panel such that selected fastener receiving openings in the siding attachment member extend in overlapping alignment with the elongate slots formed in the rigid foam insulating panel. The elongate slots in the rigid foam insulating panel are sized relative to fasteners driven through the fastener receiving openings in the siding attachment member to permit the rigid foam insulating panel to slide laterally relative to fasteners driven through overlappingly aligned fastener receiving openings in the siding attachment member and elongate slots in the rigid foam insulating panel.

BRIEF DESCRIPTION OF THE DRAWINGS

FIG. 1 is an exploded and fragmentary perspective view of a siding panel supported on a siding attachment bracket.

FIG. 2 is a fragmentary, front elevational view of the siding panel secured to the siding attachment bracket.

FIG. 3 is a fragmentary, cross-sectional view of a plurality of siding panels secured to a plurality of siding attachment brackets in vertically spaced alignment and shown secured to a wall of a building.

FIG. 4 is a fragmentary perspective view of the siding attachment bracket showing a pair of longitudinally extending stiffening ribs formed in a web of the bracket, a vertically oriented score line formed in the web and a notch formed in a siding support shoulder of the bracket.

FIG. 5 is a rear perspective view of the siding attachment bracket showing use of tin snips to cut through upper and lower support legs of the siding attachment bracket in line with one of the score lines formed in the web of the bracket.

FIG. 6 is a reduced, front perspective view of a siding attachment bracket showing a section bent relative to one of the score lines and notch formed in the bracket.

FIG. 9 is a fragmentary and exploded perspective view of a pair of vertically aligned alternative siding panel assemblies each including a siding panel and a rigid foam insulating panel secured together with a guide strip and back strip and guide pin.

FIG. 10 is a cross-sectional view of the siding panel assemblies of FIG. 9 and showing the siding panel assemblies secured to a wall of a building.

DETAILED DESCRIPTION OF THE PREFERRED EMBODIMENTS

Figure 7:
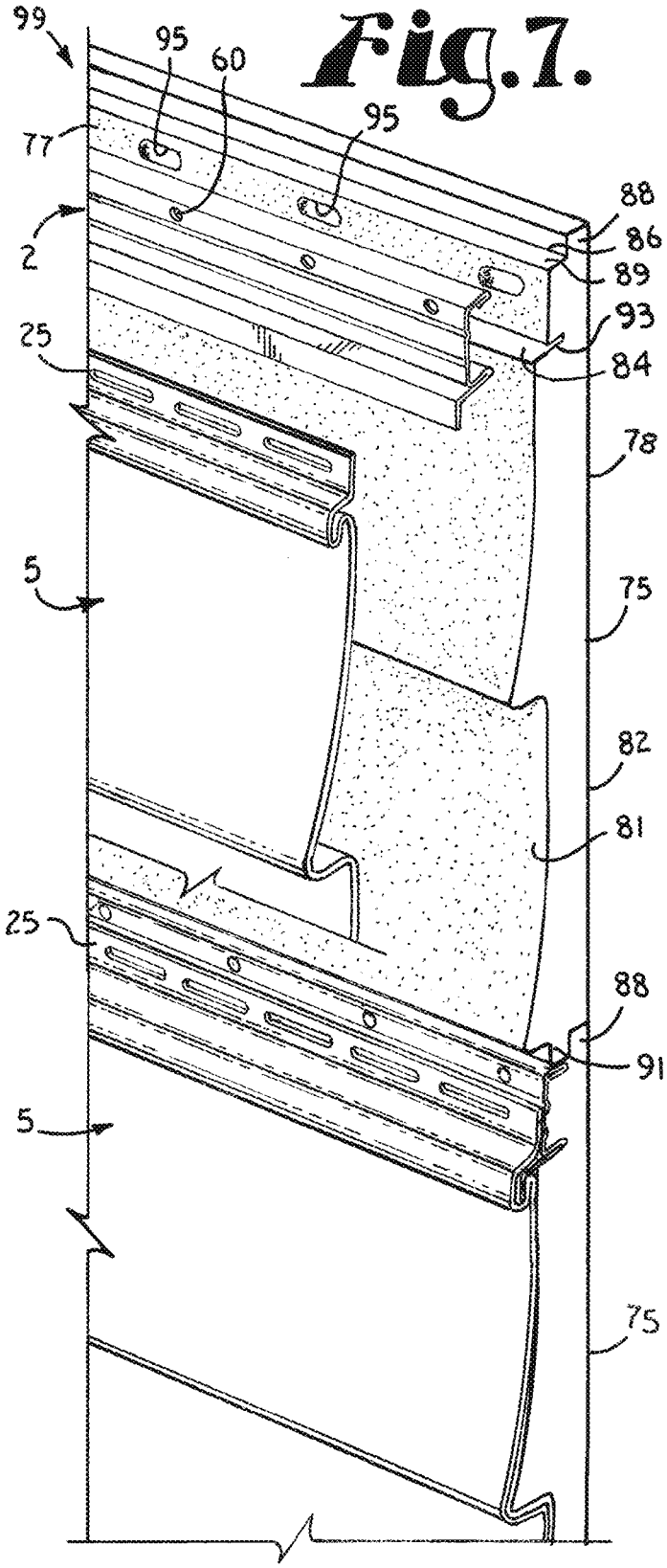
FIG. 7 is a fragmentary and exploded perspective view of a pair of vertically aligned siding panel assemblies each including the siding panel and siding attachment bracket of FIG. 1 in combination with a rigid foam insulation panel.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail the reference numeral 1 generally refers to a siding attachment system of the present invention, as shown in FIGS. 1-3 which includes a siding bracket 2 supporting and securing a siding panel 5 to the outer wall 6 of a building. The system 1 may also include an optional siding clip as shown in FIG. 7 of my prior U.S. Pat. No. 5,575,127, the disclosure of which is incorporated herein by reference. For the purposes of this application, the orientation of the component parts of the siding attachment system and siding panels are described in terms of their orientation when secured to a vertical wall as shown in FIG. 1.

The system 1 is designed to support the type of siding panels 5, as shown in FIGS. 1-3, having a lower edge 8 which projects rearwardly from a front surface 9 and rear surface 10 thereof and upwardly to form an upwardly directed longitudinal channel 11 with an upstanding inner leg 12. A top portion 14 of each panel 5 is formed to provide an outwardly and downwardly projecting longitudinal lip 15. The downwardly projecting longitudinal lip 15 forms a downwardly opening channel 16 which is adapted to receive the upstanding inner leg 12 on the lower edge 8 of the next panel 5 positioned thereabove such that the lip 15 of one panel 5 interlocks with the upstanding inner leg 12 of the panel 5 positioned thereabove.

The siding panels 5 are formed from a single sheet of material. The downwardly projecting longitudinal lip 15 is generally formed by a fold in the material forming the panel 5. The fold in the material forms an upwardly and rearwardly opening L-shaped channel 17 in the downwardly projecting longitudinal lip 15 which opens to the rear surface 10 of the panel 5.

A securement flange 25 extends above the longitudinal lip 15 of each panel 5. The securement flange 5 may include elongate nail slots 26 through which fasteners such as nails 27 may be driven for supporting the panel 5. The slots 26 are designed to permit lateral movement of the siding panel 5 through expansion and contraction when the panel 5 is secured to a wall by nails or similar fasteners.

The siding attachment bracket 2 comprises a vertically extending web 40, upper and lower support legs or flanges 41 and 42 and siding support shoulder 43. The upper support leg 41 extends rearwardly from the web 40 at an upper end thereof and the lower support leg 42 extends rearwardly from the web 40 at a lower end thereof. The support legs 41 and 42 are preferably of equal length. The siding support shoulder 43 includes a horizontal leg 50 and a vertical leg 51. The horizontal leg 50 of the shoulder 43 extends forwardly from the web 40 at a lower end thereof. The vertical leg 51 extends downwardly from a distal end of the horizontal leg 50.

The bracket 2 is formed from a single thin sheet of rigid yet malleable or bendable material such as aluminum which is folded to form the web 40, legs 41 and 42 and shoulder 43. In particular, the material, laying horizontally is folded over and on top of itself 360 degrees generally to form the upper support leg 41. The material is then folded downward 90 degrees to form the web 40. The material is then folded rearwardly 90 degrees and back forwardly 360 degrees to form the lower support leg 42 and the horizontal leg 50 of the siding support shoulder 43. The material is then folded downwardly 90 degrees to form the support shoulder vertical leg 51. It is foreseen that the bracket may also be formed from other relatively rigid materials including plastic through molding or extrusion.

Nail or fastener holes 60 are punched or otherwise formed in an upper portion of the web 40. The holes 60 are formed in the web 40 an equal distance apart along a single line extending the entire length of the bracket 2. The spacing of the nail holes 60 is typically four inches apart to accommodate a variety of spacings for studs including four, eight, twelve or sixteen inches, with sixteen inches corresponds with a standard spacing of studs forming a wall 6. Holes 6 are preferably side slightly wider in diameter than the shaft of a fastener but smaller than the fastener head.

A plurality of stiffening ribs 62, two in the embodiment shown, are formed in the vertically extending web 40 of bracket 2. The ribs 62 extend longitudinally and in parallel spaced relationship the entire length of the bracket 2. In the embodiment shown in FIGS. 1-3, the ribs 62 are formed as grooves extending into the front face of the web 40 such that the peaks project outward from the rear face of the web 40. The two ribs 62 increase the rigidity of the bracket 2 relative to forces applied perpendicular to the ribs 62.

The siding attachment brackets 2 may be cut or formed to any length but are preferably cut to a length generally equal to the length of the wall 6 or surface onto which the siding panels 5 are to be attached. As best seen in FIGS. 4 and 5, vertically extending score lines 64 are formed in the vertically extending web 40 of bracket 2 in spaced relationship. In the embodiment shown, the score lines are equally spaced apart and are preferably spaced twelve inches apart. A notch 66 is cut or formed in the horizontal and vertical legs 50 and 51 of the siding support shoulder 43 in alignment with each score line 64. The score lines 64 form lines of weakness or a guide for cutting vertically through the web 40 of bracket 2, using tin snips 67 or other means for cutting sheet metal, after cuts are made through the upper and lower support legs 41 and 42 of bracket 2. Alternatively, after the legs 41 and 42 are cut, a first portion 68 of bracket 2 on a first side of the score line 64, may be repetitively bent relative to a second portion 69, until the first portion 68 separates from the second portion 69 through metal fatigue.

The rigidity provided by ribs 62 permit use of thinner sheet metal to form the bracket 2 which makes it easier to cut through using tin snips 67 or the like to cut the bracket 2 to a desired length. The additional rigidity also compensates for the weakening of the bracket 2 due to inclusion of the notches 66 and score lines 64 in the bracket 2.

After the bracket 2 is cut to length, it is secured to an exterior wall 6 to extend horizontally by driving fasteners through the fastener holes 60 and into wall 6. A siding panel 5 is attached to the bracket 2 so that the siding support shoulder 43 is positioned in the upwardly and rearwardly opening L-shaped channel 17 such that the panel 5 is generally supported on the horizontal leg 50 of the shoulder 43 of bracket 2 and free to advance along the length of the horizontal leg 50 such as through expansion and contraction. A panel 5 may be secured to the bracket 2 by sliding the siding support shoulder 43 through the upwardly and rearwardly opening L-shaped channel 17 of the panel 5 from one end thereof. A panel 5 may also be snapped into place on a bracket 2. In such a procedure, a bracket 2 is generally aligned with a panel 5 along their lengths such that a leading edge of the vertical leg 51 of the siding support shoulder 43 extends into the upwardly and rearwardly opening L-shaped channel 17. The bracket 2 is then pulled forward relative to the panel 5 (or vice-versa) such that the shoulder 43 advances into or "snaps" into the channel 17. It is to be understood that the siding panel 5 could be secured to the bracket 2 before or after the bracket 2 is secured to a wall 6.

Figure 8:
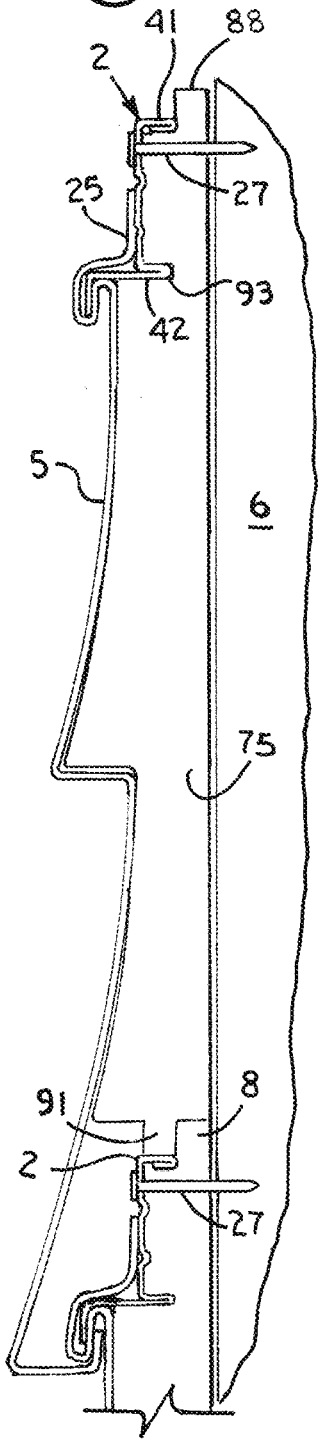
FIG. 8 is a cross-sectional view of the siding panel assemblies of FIG. 7 and showing the siding panel assemblies secured to a wall of a building.

Referring to FIGS. 7 and 8, the bracket 2 is shown used in association with rigid foam insulating panels 75 positioned between the siding panel 5 and the outer wall 6 of a building. The foam panels 75 are positioned against and contoured to conform to the rear surface 10 of the associated siding panel 5. The foam panels 75 may be adhered to an associated siding panel 5 or simply positioned against the siding panel 5. In addition, the foam panel 75 may be of a uniform thickness instead of contoured.

An upper section 77 of each foam panel 75 generally comprises a mounting flange or bracket mating section 77. In the embodiment shown, the mounting flange 77 is thinner than the portion of the foam panel 75 extending therebelow, a lower section 78, to accommodate a rearward offset of the securement flange 25 of the siding panel 5 to be secured against the foam panel 75.

The foam panel 75 includes front and rear faces 81 and 82. In the embodiment shown, a first or lower rearwardly extending shoulder 84 is formed in the front face 81 between the mounting flange 77 and the lower section 78 of the foam panel 75. A laterally extending notch or groove 86 is formed in the front face 81 of foam panel 75 along an upper edge thereof so that upstanding lip or finger 88 is formed across the back and upper end of the foam panel 75. A second or upper rearwardly extending shoulder 89 is formed in the front face 81 between the mounting flange 77 and the upstanding lip 88.

A depending tongue or lip 91 projects downward from a lower end of the foam panel 75 a distance corresponding to or slightly shorter than the height of the upstanding lip 88. The depending lip 91 is spaced forward from a rear face 82 of the foam panel 75 a distance corresponding to the thickness of the upstanding lip 88. The spacing and size of the upstanding and depending lips 88 and 91, allows the upstanding lip 88 of a first foam panel 75 to extend behind and in overlapping relationship with the depending lip 91 of a second foam panel 75 positioned above the first foam panel 75. Overlapping of the upstanding and depending lips 88 and 91 of vertically adjacent panels 75 reduces air gaps and improves the insulating function of the panels 75.

A groove 93 is formed in the front face 81 of foam panel 75 and extends laterally across the panel 75 in planar alignment with the lower rearwardly extending shoulder 84. The groove 93 extends to a depth consistent with the depth of the upper rearwardly extending shoulder 89. Groove 93 is sized to receive therein the lower support leg 42 of one of the siding attachment brackets 2 with the upper support leg 41 of the bracket 2 extending just above the upper rearwardly extending shoulder 89.

Elongate slots 95 are formed in and through the mounting flange 77 of each foam panel 75. The slots 95 are equally spaced and extend in longitudinal alignment across the mounting flange 77. Centers of the slots 95, along the longitudinal axis, are spaced apart the same distance as the spacing between the centers of the fastener holes 60 in the siding attachment bracket 2. In one embodiment, the spacing is preferably 4 inches. The slots 95 are preferably considerably wider than the fasteners, such as nails or screws, driven through fastener holes 60 to mount the bracket 2, siding panel 5 and foam panel 75 to a wall 6. The elongate slots 95 are formed in the mounting flange 77 of each foam panel 75 so that the slots 95 are longitudinally aligned with a line through the fastener holes 60 of a bracket 2 secured against the panel 75 with lower support leg 41 of bracket 2 in the bracket receiving groove 93. The lateral position of the bracket 2 relative to the foam insulating panel 75 is adjusted until the fastener holes 60 in bracket 2 overlap the elongate slots 95 in the foam panel 75. Fasteners are then driven through selected sets of aligned holes 60 and slots 95 in the bracket 2 and foam panel 75 and into wall 6 to secure the bracket 2 and foam panel 75 to the wall 6. The elongate slots 95 in the foam panels 75 allow the panels to move laterally relative to the fasteners 60, the bracket 2 and wall 6 to accommodate changes in the shape of the wall due to settling and other forces. By allowing the foam panels 75 to shift relative to the fasteners 60, bracket 2 and wall 6, the foam panels 75 are less likely to bind or crack. As with the embodiment, shown in FIG. 1, a siding panel 5 may be secured to the bracket 2 before or after the bracket 2 is attached to the wall 6. The siding panel 5 in combination with the foam panel 75 may be referred to as a siding panel assembly 99.

Referring to FIGS. 9 and 10, an alternative siding panel assembly 101 is shown which is similar to the panel assembly shown in FIGS. 13-15 of my prior U.S. Pat. No. 7,890,038, the disclosure of which is incorporated herein by reference. The siding panel assembly 101, as shown in FIGS. 9 and 10 of the present application, includes a similar siding panel 104 but a modified foam insulating panel 112 relative to the foam panel shown in FIGS. 13-15 of U.S. Pat. No. 7,890,038. Siding panel 104 includes a single wall nailing hem 106 and a downwardly curved lip 108 extending outward and downward from an upper edge of the nailing hem 106. A plurality of slots 110 are formed in spaced relationship through and across the nailing hem 106. In the embodiment shown, the spacing of the slots 110 is preferably an equal spacing of approximately two inches between centers of adjacent slots 110. The rigid foam insulating panel 112 is positioned against and contoured to conform to a rear surface 114 of the siding panel 104. The foam panel 112 may be adhered to the siding panel 104 or simply positioned against the siding panel 104 although a non-adhered configuration may be preferred to allow independent lateral movement or expansion and contraction of the foam panel 112 relative to the siding panel 104. The foam panel 112 may be of a uniform thickness instead of contoured.

The siding panel assembly 101 includes a guide strip 120 including a plurality of guide receiving apertures 122 formed therein. The assembly 101 further includes a back panel or strip 124 and a plurality of tubular fastener guides, ferrules or pins 126. The back panel 124 is preferably similarly sized relative to the guide strip 120 and includes a plurality of guide receiving apertures 128 formed therein in a spacing corresponding to the spacing of apertures 122 in the guide strip 120. Back panel 124 is also preferably formed from materials such as plastic, vinyl or metal which are sufficiently flexible to permit the panel 124 flex forward and backwards but which does not compress or flex vertically.

Each pin 126 includes a shaft 130 and an enlarged head 132 with a fastener receiving bore 134 extending axially through the pin 126. The end 135 of each pin 126 opposite the head may be barbed or slightly enlarged. The shaft 130 of each pin 126 is sufficiently long to allow the shaft 130 to be inserted through an aperture 122 in the guide strip 120, through one of the slots 110 in the nailing hem 106 of the siding panel 104, through an elongate slot 136 in the foam panel 112 and through an aligned aperture 128 in the back panel 124 with the head 132 of the pin 126 positioned proximate the front face of the guide strip 120. The slots 136 in the foam layer 112 are preferably preformed therein by a punch tool or the like.

Centers of the apertures 122 in guide strip 120 and apertures 128 in back panel 124 are spaced apart a distance corresponding to the distance between centers of selected elongate slots 110 in the nailing hem or securement flange 106. In a preferred embodiment, the centers of the apertures 122 and 128 are spaced four inches apart, corresponding to one of each of the apertures 122 and 128 for every two slots 110. It is foreseen that the spacing of apertures 122 and 128 relative to the number of slots 110 could be varied, including one set of apertures 122 and 128 for every slot 110, for every third slot 110 and so on. It is also foreseen that the spacing between the slots 110 could be varied to include random or varied and that the spacing of apertures 122 and 128 would be selected in a pattern or spacing to correspond to the pattern or spacing of selected slots 110.

The elongate slots 136 are formed in and through a mounting flange 137 of each foam panel 112. The slots 136 are equally spaced and extend in longitudinal alignment across the mounting flange 137. Centers of the slots 136, along the longitudinal axis, are spaced apart the same distance as the spacing between the centers of the guide receiving apertures 122 and 128 in the guide strip 120 and back strip 124 respectively or other variations including the spacing of the centers of slots 136 corresponding to the spacing of centers of multiple adjacent sets of apertures 122 and 128. In one embodiment, the spacing is preferably 4 inches. The elongate slots 136 are formed in the mounting flange 137 of each foam panel 112 so that the slots 136 are longitudinally aligned with lines extending through centers of the guide receiving apertures 122 and of guide receiving apertures 128.

The spacing of the pins 126 and their bores 134 will correspond to the spacing of the apertures 122 and 128 in guide strip 120 and back strip 124 respectively through which they are inserted or relative to which they extend. The outer diameter of pin shaft 130 is sized slightly larger than the diameter of the apertures 122 in the guide strip 120 and apertures 128 in the back panel 124 to form a friction fit for holding the assembly 101 together. The friction fit is sufficient to hold the assembly 101 together, with the siding panel 104 and foam layer 112 positioned between the guide strip 120 and back panel 124, while the assembly is positioned against a substrate 140 and fasteners 142 (such as nails or screws), are driven through axial bores 134 in the pins 126 and into the substrate 140. The slots 136 in the mounting flange 137 of each foam panel 112 are preferably considerably wider than the fastener guides 126 and slightly taller than the diameter of the fastener guides 126 so that the foam panel 112 can move or slide laterally relative to a plurality of fastener guides 126 inserted through associated slots 136. As with foam panel 75, the ability of the foam panel 112 to slide laterally relative to fastener guide pins 126 allows the foam panel 112 to move independent of the substrate 140 to which it is secured and independent of the siding panel 104 associated therewith which reduces excess deformation or stress on the foam panels 112 which can result in undesirable cracking or creasing or bulging of the foam panels 112.

When fasteners 142 are driven through tubular guide pins 126 extending through apertures 122 and 128 and slots 136, the fasteners 142 are spaced a distance corresponding to the distance between centers of selected elongate slots 110. The preferred four inch spacing allows the spacing of the fasteners 142 to correspond to a standard sixteen inch spacing of studs in a wall to which the siding panels 104 are to be attached. It is to be understood that fasteners 142 do not have to be driven through every nail guide or pin 126 included in the nail guide assembly 101.

The outer diameter of each pin 126 is also smaller than the height of each slot 110 in the nailing hem 106 while the slots 110 are significantly wider than the diameter of the pins 126, such that the siding panel 104 can slide relative to the pins 126 once the pins 126 are secured in place with fasteners 142 driven through the tubular pins 126 and into the substrate 140. By spacing the fasteners 142 a distance apart corresponding to the distance between centers of the corresponding slots 110, the fasteners 142 cannot be positioned to bind the siding panel 104 and prevent the siding panel 104 from sliding.

In addition, the shaft 130 of each pin 126 is sized to be longer than the combined thickness of the siding panel 104, foam panel 112, guide strip 120 and back panel 124 to prevent compression of these separate layers against one another. By avoiding compression of any of the other layers against the securement flange 106 of the siding panel 104, the siding panel 104 is allowed to slide laterally relative to the pins 126, foam panel 112, guide strip 120 and back panel 124.

Figure 11:
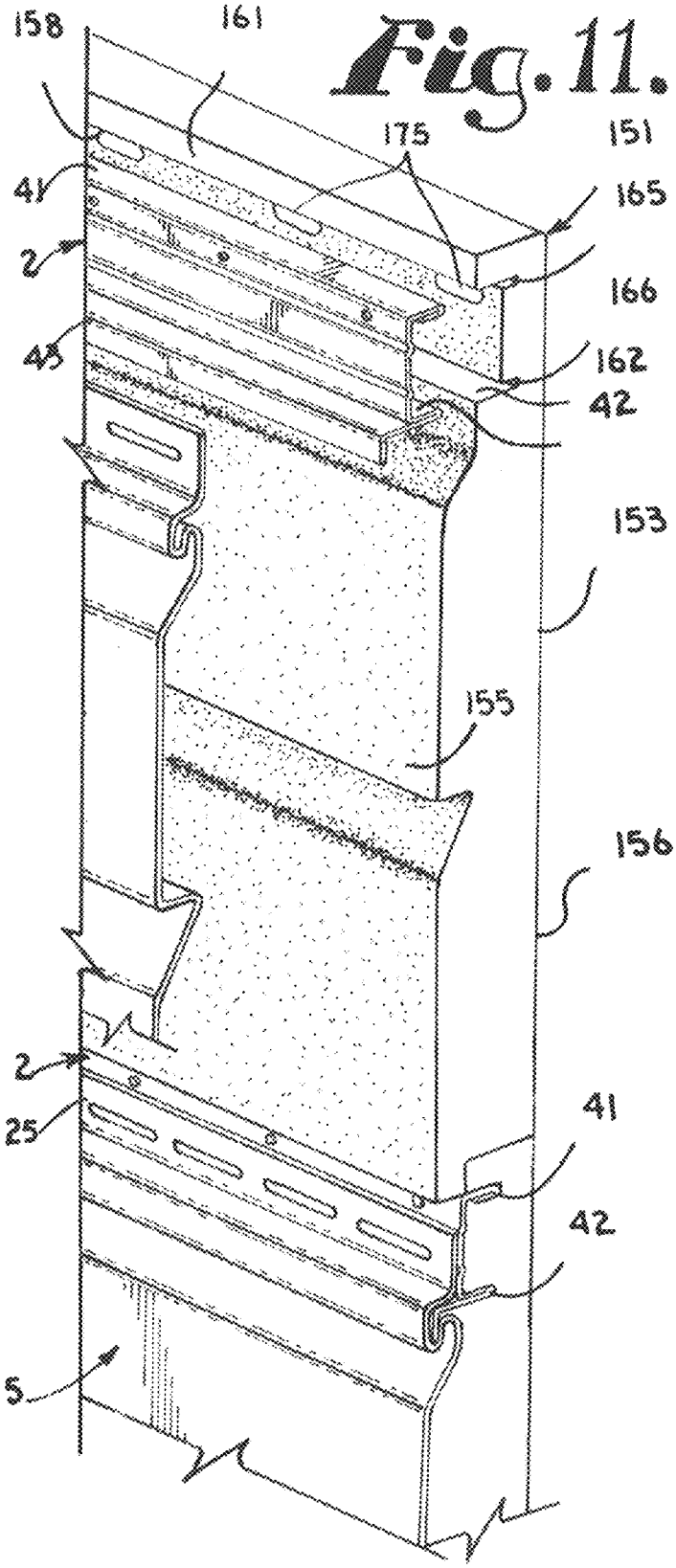
FIG. 11 is a fragmentary and exploded perspective view of a pair of vertically aligned siding panel assemblies each including the siding panel and siding attachment bracket of FIG. 1 in combination with an alternative embodiment of the rigid foam insulation panel.
Figure 12:
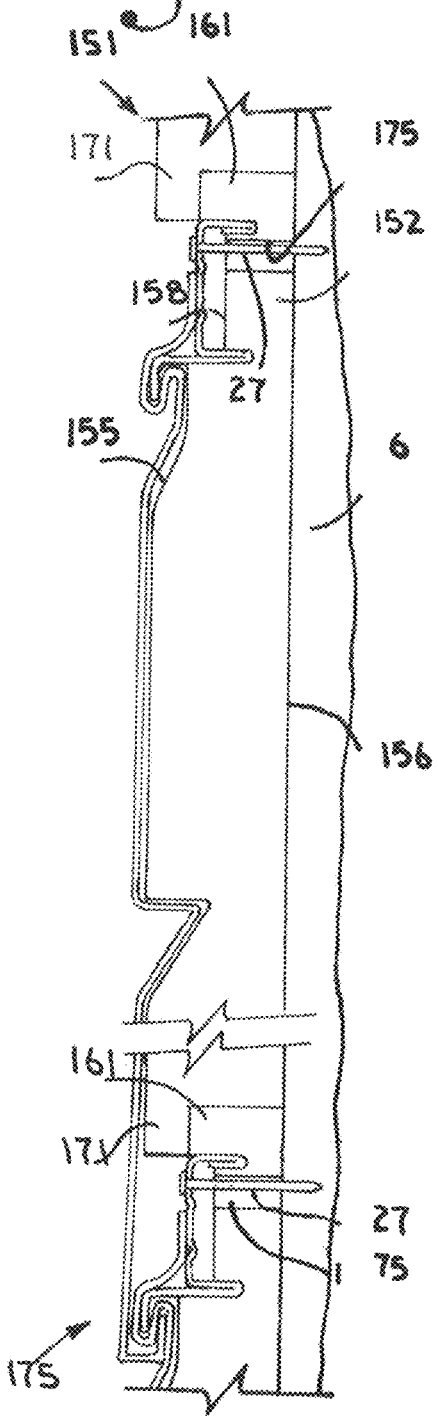
FIG. 12 is a cross-sectional view of the siding panel assemblies of FIG. 11 and showing the siding panel assemblies secured to a wall of a building.

Referring to FIGS. 11 and 12, the bracket 2 is shown used in association with an alternative embodiment of a rigid foam insulating panel 151 positioned between the siding panel 5 and the outer wall 6 of a building. An upper section of each foam panel 151 generally comprises a mounting flange or bracket mating section 152. In the embodiment shown in FIGS. 11 and 12, the mounting flange 152 is thinner than the portion of the foam panel 151 extending therebelow, a lower section 153, to accommodate a rearward offset of the securement flange 25 of the siding panel 5 to be secured against the foam panel 75.

The foam panel 151 includes front and rear faces 155 and 156. A bracket receiving recess 158 is formed in the front face 155 of the upper section or mounting flange 152. A forwardly projecting lip, or first overlapping feature, 161 is formed above and extends along an upper edge of the bracket receiving recess 158 and a rearwardly extending shoulder 162 is formed in the front face 155 at the lower edge of the bracket receiving recess 158 and. Upper and lower leg receiving grooves 165 and 166 are formed in the foam deeper than the recess 158 and along the upper and lower edges thereof. Grooves 165 and 166 are sized to receive therein the upper and lower support legs 42 and 43 respectively of a bracket 2 inserted in bracket receiving recess 158 with the web 40 of bracket 2 extending generally in vertical alignment with a front edge of the forwardly projecting lip 161 and the siding support shoulder 43 of bracket 2 extending forward of the portion of the foam panel mounting flange 152 extending therebelow.

A depending tongue or lip 171, which functions as a second overlapping feature, projects downward from a lower end of the foam panel 151, proximate a front face 155 thereof, a distance corresponding to or slightly shorter than the height of the forwardly projecting lip 151 at the upper end of the panel 151. A rear surface of the depending lip 171 is spaced forward from the rear face 156 of the foam panel 151 a distance corresponding to the thickness of the forwardly projecting lip 161. The spacing and size of the forwardly projecting depending lips 161 and 171, allows the depending lip 161 of a first foam panel 151 to extend in front of and in overlapping relationship with the forwardly projecting lip 161 of a second foam panel 151 positioned below the first foam panel 151. Overlapping of the depending and forwardly projecting lips 171 and 161 of vertically adjacent panels 151 reduces air gaps and improves the insulating function of the panels 151.

Elongate slots 175 are formed in and through the mounting flange 152 of each foam panel 151 in the recess 158. The slots 175 are equally spaced and extend in longitudinal alignment across the mounting flange 152. Centers of the slots 175, along the longitudinal axis, are spaced apart the same distance as the spacing between the centers of the fastener holes 60 in the siding attachment bracket 2. In one embodiment, the spacing is preferably 4 inches. The slots 175 are preferably considerably wider than the fasteners, such as nails or screws, driven through fastener holes 60 to mount the bracket 2, siding panel 5 and foam panel 151 to a wall 6. The elongate slots 95 are formed in the mounting flange 152 of each foam panel 151 so that the slots 175 are longitudinally aligned with a line through the fastener holes 60 of a bracket 2 secured in the bracket receiving recess 158 of the panel 151 with upper and lower support legs 40 and 41 of bracket 2 received in the upper and lower leg receiving groove 165 and 166 respectively. The lateral position of the bracket 2 relative to the foam insulating panel 151 is adjusted until the fastener holes 60 in bracket 2 overlap the elongate slots 175 in the foam panel 151. Fasteners are then driven through selected sets of aligned holes 60 and slots 175 in the bracket 2 and foam panel 151 and into wall 6 to secure the bracket 2 and foam panel 151 to the wall 6. The elongate slots 175 in the foam panels 151 allow the panels to move laterally relative to the fasteners 60, the bracket 2 and wall 6 to accommodate changes in the shape of the wall due to settling and other forces. By allowing the foam panels 151 to shift relative to the fasteners 60, bracket 2 and wall 6, the foam panels 151 are less likely to bind or crack. As with the embodiment, shown in FIG. 1, a siding panel 5 may be secured to the bracket 2 before or after the bracket 2 is attached to the wall 6. The siding panel 5 in combination with the foam panel 151 may be referred to as a siding panel assembly 177.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

Having thus described the invention, what is claimed as new and desired to be secured by Letters Patent is as follows:

1. A siding panel assembly comprising:

a siding attachment member having a plurality of fastener receiving openings extending through the siding attachment member in equally spaced relationship, longitudinally across the siding attachment member;

a siding panel having means for coupling the siding panel to the siding attachment member which permits lateral sliding of the siding panel relative to the siding attachment member;

a rigid foam insulating panel having a plurality of elongate slots extending therethrough in equally spaced relationship, longitudinally across the rigid foam insulating panel wherein a spacing between centers of selected ones of the elongate slots corresponds to a distance between centers of selected fastener receiving openings in said siding attachment member;

said siding attachment member positionable in overlapping relationship with said rigid foam insulating panel such that said selected fastener receiving openings in said siding attachment member extend in overlapping alignment with selected ones of the elongate slots formed in the rigid foam insulating panel;

said elongate slots in said rigid foam insulating panel are sized relative to fasteners driven through said fastener receiving openings in said siding attachment member to permit said rigid foam insulating panel to slide laterally relative to fasteners driven through overlappingly aligned fastener receiving openings in said siding attachment member and elongate slots in said rigid foam insulating panel;

wherein, when said siding panel is coupled to said siding attachment member and said siding attachment member is positioned in overlapping relationship with said rigid foam insulating panel and fasteners are driven through at least some of said fastener receiving openings in said siding attachment member and at least some of said elongate slots in said rigid foam insulating panel, said siding panel is slidable laterally relative to said foam panel; and wherein said siding attachment member comprises a siding attachment bracket which includes:

a generally vertically extending web through which said plurality of fastener receiving openings extend; and at least one support leg extending rearwardly from said web; and wherein said means for coupling said siding panel to said siding attachment member comprises a siding support shoulder including a horizontal leg and a vertical leg, wherein said horizontal leg is connected to said web at a first end and extends forwardly from said web and ends at a distal end and said vertical leg extends downwardly from said distal end of said horizontal leg.

2. The siding panel assembly as in claim 1 further comprising at least one stiffening rib formed in said vertically extending web and extending longitudinally relative thereto.

3. The siding panel assembly as in claim 1 further comprising at least two stiffening ribs formed in said vertically extending web and extending longitudinally relative thereto in vertically spaced and parallel relation to each other.

4. The siding panel assembly as in claim 1, wherein said fastener receiving openings in said siding attachment member are sized slightly wider in diameter than the shaft of a fastener to be inserted therein but smaller than the head of the fastener and said elongated slots in said rigid foam insulating panel are wider than said fastener receiving openings in said siding attachment member.

5. A siding panel assembly comprising:

a siding attachment member having a plurality of fastener receiving openings extending through the siding attachment member in equally spaced relationship, longitudinally across the siding attachment member;

a siding panel having means for coupling the siding panel to the siding attachment member which permits lateral sliding movement of the siding panel relative to the siding attachment member;

a rigid foam insulating panel having a plurality of elongate slots extending therethrough in equally spaced relationship, longitudinally across the rigid foam insulating panel wherein a spacing between centers of selected ones of the elongate slots corresponds to a distance between centers of selected fastener receiving openings in said siding attachment member;

said siding attachment member is positionable in overlapping relationship with said rigid foam insulating panel such that said selected fastener receiving openings in said siding attachment member extend in overlapping alignment with selected ones of the elongate slots formed in the rigid foam insulating panel;

said elongate slots in said rigid foam insulating panel are sized relative to fasteners driven through said fastener receiving openings in said siding attachment member to permit said rigid foam insulating panel to slide laterally relative to fasteners driven through overlappingly aligned fastener receiving openings in said siding attachment member and elongate slots in said rigid foam insulating panel; wherein said siding attachment member comprises a siding attachment bracket which includes a generally vertically extending web through which said plurality of fastener receiving openings extend and at least one support leg extending rearwardly from said web; wherein said means for coupling said siding panel to said siding attachment member comprises a siding support shoulder including a horizontal leg and a vertical leg, wherein said horizontal leg is connected to said web at a first end and extends forwardly from said web and ends at a distal end and said vertical leg extends downwardly from said distal end of said horizontal leg; and wherein:

a plurality of vertically extending score lines are formed in the vertically extending web in equally spaced relationship;

a plurality of notches are formed in the vertical leg and horizontal leg of the siding support shoulder wherein each of the plurality of notches is axially aligned with a respective one of the plurality of vertically extending score lines formed in the vertically extending web.

6. The siding panel assembly as in claim 5 further comprising at least one stiffening rib formed in said vertically extending web and extending longitudinally relative thereto.

7. In a siding attachment bracket including a generally vertically extending web having a plurality of holes formed in an upper portion of said web and extending across said web in linear alignment, said holes sized to receive the shaft of a fastener therethrough, first and second support legs extending longitudinally and rearwardly from said web in spaced apart relation, and a siding support shoulder including a horizontal leg and a vertical leg, wherein said horizontal leg extends forwardly from said web proximate a lower end thereof and ends at a distal end and said vertical leg extends downwardly from said distal end of said horizontal leg; the improvement comprises:

a plurality of vertically extending score lines formed in the vertically extending web in equally spaced relationship;

a plurality of notches formed in the vertical leg and horizontal leg of the siding support shoulder wherein each of the plurality of notches is axially aligned with a respective one of the plurality of vertically extending score lines formed in the vertically extending web;

in combination with a rigid foam insulating panel having a plurality of elongate slots formed in an upper section of the rigid foam insulating panel and extending in longitudinal alignment and equal spaced relationship thereacross; centers of adjacent elongate slots in the rigid foam insulating panel spaced apart a distance corresponding to a distance between centers of selected holes in said vertically extending web, said siding attachment bracket positionable against said rigid foam insulating panel such that said selected holes in said vertically extending web extend in overlapping alignment with the elongate slots formed in the rigid foam insulating panel.

8. A plurality of siding attachment brackets in combination with a plurality of rigid foam insulating panels as in claim 7 wherein each rigid foam insulating panel has a first overlapping feature formed on an upper end thereof and a second overlapping feature from on a lower end thereof and the second overlapping feature on a first rigid foam insulating panel extends in overlapping relationship with the first overlapping feature on a second rigid foam insulating panel positioned below and adjacent the first rigid foam insulating panel.

9. The siding attachment bracket in combination with the rigid foam insulating panel as in claim 7 wherein at least one leg receiving groove is formed in and extends laterally across a front face of said rigid foam insulating panel and is sized to receive one of said first or second support legs of said siding attachment bracket therein when said siding attachment bracket is positioned against said front face of said rigid foam insulating panel with said selected holes in said siding attachment bracket extending in overlapping alignment with the elongate slots formed in the rigid foam insulating panel.

10. The siding attachment bracket in combination with the rigid foam insulating panel as in claim 7 wherein first and second leg receiving grooves are formed in and extend laterally across a front face of said rigid foam insulating panel and are sized to receive said first or second support legs respectively of said siding attachment bracket therein when said siding attachment bracket is positioned against said front face of said rigid foam insulating panel with said selected holes in said siding attachment bracket extending in overlapping alignment with the elongate slots formed in the rigid foam insulating panel.

11. In a siding attachment bracket including a generally vertically extending web having a plurality of holes formed in an upper portion of said web and extending across said web in linear alignment, said holes sized to receive the shaft of a fastener therethrough, first and second support legs extending longitudinally across and rearwardly from said web, and a siding support shoulder including a horizontal leg and a vertical leg, wherein said horizontal leg extends forwardly from said web and ends at a distal end and said vertical leg extends downwardly from said distal end of said horizontal leg; the improvement comprises:

a plurality of vertically extending score lines formed in the vertically extending web in equally spaced relationship;

at least one stiffening rib formed in said vertically extending web and extending longitudinally relative thereto and between the first and second support legs;

in combination with a rigid foam insulating panel having a plurality of elongate slots formed in an upper section of the rigid foam insulating panel and extending in longitudinal alignment and equal spaced relationship thereacross; centers of adjacent elongate slots in the rigid foam insulating panel spaced apart a distance corresponding to a distance between centers of selected holes in said vertically extending web, said siding attachment bracket positionable against said rigid foam insulating panel such that said selected holes in said vertically extending web extend in overlapping alignment with the elongate slots formed in the rigid foam insulating panel.

12. A plurality of siding attachment brackets in combination with a plurality of rigid foam insulating panels as in claim 11 wherein each rigid foam insulating panel has a first overlapping feature formed on an upper end thereof and a second overlapping feature from on a lower end thereof and the second overlapping feature on a first rigid foam insulating panel extends in overlapping relationship with the first overlapping feature on a second rigid foam insulating panel positioned below and adjacent the first rigid foam insulating panel.

13. The siding attachment bracket in combination with the rigid foam insulating panel as in claim 11 wherein at least one leg receiving groove is formed in and extends laterally across a front face of said rigid foam insulating panel and is sized to receive one of said first or second support legs of said siding attachment bracket therein when said siding attachment bracket is positioned against said front face of said rigid foam insulating panel with said selected holes in said siding attachment bracket extending in overlapping alignment with the elongate slots formed in the rigid foam insulating panel.

14. The siding attachment bracket in combination with the rigid foam insulating panel as in claim 11 wherein first and second leg receiving grooves are formed in and extend laterally across a front face of said rigid foam insulating panel and are sized to receive said first or second support legs respectively of said siding attachment bracket therein when said siding attachment bracket is positioned against said front face of said rigid foam insulating panel with said selected holes in said siding attachment bracket extending in overlapping alignment with the elongate slots formed in the rigid foam insulating panel.

15. In a siding attachment bracket including a generally vertically extending web having a plurality of holes formed in an upper portion of said web and extending across said web in linear alignment, said holes sized to receive the shaft of a fastener therethrough, an upper support leg extending rearwardly from said web at an upper end thereof, a lower support leg extending rearwardly from said web at a lower end thereof, and a siding support shoulder including a horizontal leg and a vertical leg, wherein said horizontal leg extends forwardly from said web proximate a lower end thereof and ends at a distal end and said vertical leg extends downwardly from said distal end of said horizontal leg; the improvement comprises:

at least one stiffening rib formed in said vertically extending web and extending longitudinally between the upper and lower support legs;

a plurality of vertically extending score lines formed in the vertically extending web in equally spaced relationship;

a plurality of notches formed in the vertical leg and horizontal leg of the siding support shoulder wherein each of the plurality of notches is axially aligned with a respective one of the plurality of vertically extending score lines formed in the vertically extending web;

in combination with a rigid foam insulating panel having a plurality of elongate slots formed in an upper section of the rigid foam insulating panel and extending in longitudinal alignment and equal spaced relationship thereacross; centers of adjacent elongate slots in the rigid foam insulating panel spaced apart a distance corresponding to a distance between centers of selected holes in said vertically extending web, said siding attachment bracket positionable against said rigid foam insulating panel such that said selected holes in said vertically extending web extend in overlapping alignment with the elongate slots formed in the rigid foam insulating panel.

16. The siding attachment bracket in combination with the rigid foam insulating panel as in claim 15 wherein at least one leg receiving groove is formed in and extends laterally across a front face of said rigid foam insulating panel and is sized to receive one of said upper or lower support legs of said siding attachment bracket therein when said siding attachment bracket is positioned against said front face of said rigid foam insulating panel with said selected holes in said siding attachment bracket extending in overlapping alignment with the elongate slots formed in the rigid foam insulating panel.

17. The siding attachment bracket in combination with the rigid foam insulating panel as in claim 15 wherein upper and lower leg receiving grooves are formed in and extend laterally across a front face of said rigid foam insulating panel and are sized to receive said upper and lower support legs respectively of said siding attachment bracket therein when said siding attachment bracket is positioned against said front face of said rigid foam insulating panel with said selected holes in said siding attachment bracket extending in overlapping alignment with the elongate slots formed in the rigid foam insulating panel.

* * * * *